United States Patent [19]

Kramer et al.

[11] 4,206,387

[45] Jun. 3, 1980

[54] ELECTRODELESS LIGHT SOURCE HAVING RARE EARTH MOLECULAR CONTINUA

[75] Inventors: Jerry M. Kramer, Acton; William H. McNeill, Carlisle; Paul O. Haugsjaa, Acton, all of Mass.

[73] Assignee: GTE Laboratories Incorporated, Waltham, Mass.

[21] Appl. No.: 941,811

[22] Filed: Sep. 11, 1978

[51] Int. Cl.[2] ..... H05B 41/16; H05B 41/24

[52] U.S. Cl. ..... 315/248; 313/225; 313/229; 315/39; 315/344

[58] Field of Search ..... 315/39, 248, 344, 267; 313/225, 229

[56] References Cited

U.S. PATENT DOCUMENTS

| | | | |
|---|---|---|---|
| 3,319,119 | 5/1967 | Rendina | 315/248 |
| 3,334,261 | 8/1967 | Butler et al. | 313/229 |
| 3,786,297 | 1/1974 | Zollweg et al. | 313/225 |
| 3,842,307 | 10/1974 | Dobrusskin et al. | 313/225 |
| 4,020,377 | 4/1977 | Popp et al. | 313/225 |

*Primary Examiner*—Saxfield Chatmon, Jr.
*Attorney, Agent, or Firm*—Fred Fisher

[57] ABSTRACT

An electrodeless lamp apparatus includes an electrodeless, light-transmitting, envelope for housing a rare-earth compound fill, and a termination fixture, electrodelessly coupled to the envelope, adapted to create an electrical condition for exciting the fill.

The fill can include mercury and a noble gas, such as argon.

The rare-earth compound is preferably a rare-earth halide, such as dysprosium iodide and holmium iodide.

The fill can include a halide of mercury, such as $HgBr_2$.

One example of a fill is $Hg/DyI_3/HoI_3/CsI/HgBr_2/Ar$.

A second example of a fill is $Hg/NdI_3/DyI_3/CsI/Ar$.

A third example of a fill is $Hg/Pr/DyI_3/HgI_2/CsI/HgBr_2/Ar$.

A fourth example of a fill is $Hg/Yb/CsCl/HgCl_2/Ar$.

18 Claims, 3 Drawing Figures

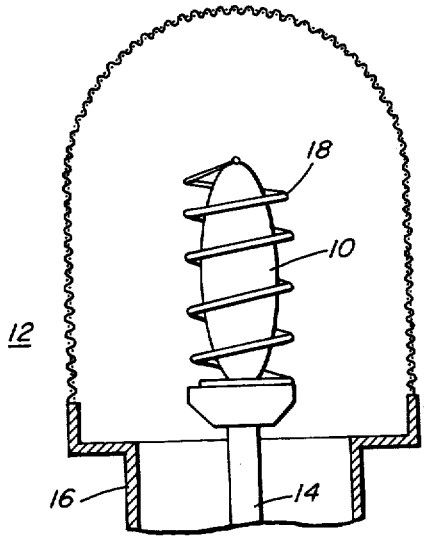
FIG. 1
FIG. 2
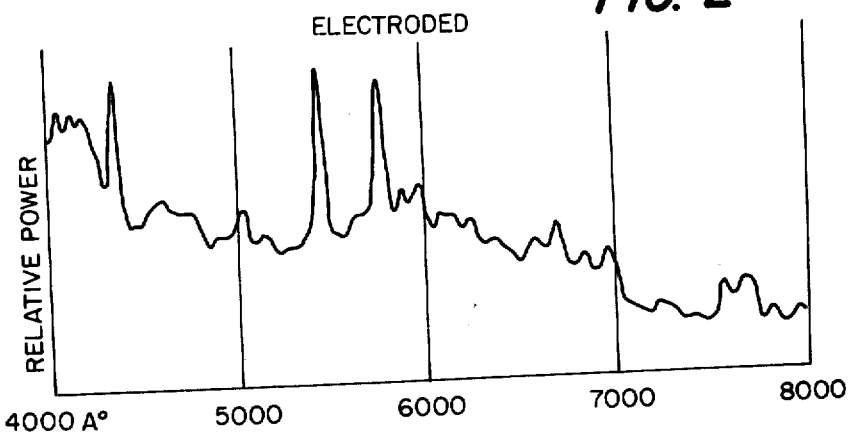
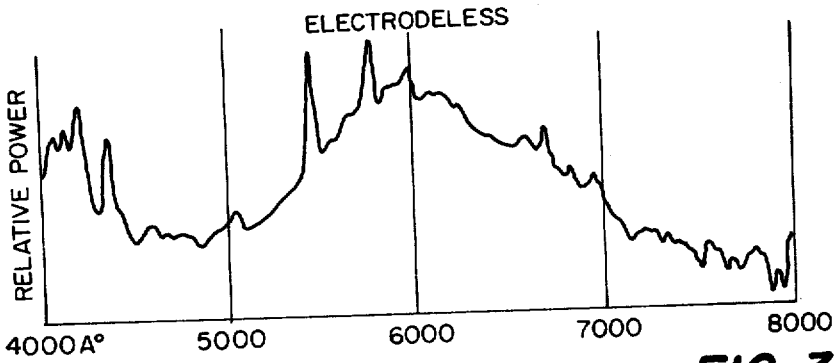
FIG. 3

ELECTRODELESS LIGHT SOURCE HAVING RARE EARTH MOLECULAR CONTINUA

BACKGROUND OF THE INVENTION

1. Field of the Invention

This invention relates to electrodeless lamps, and, in particular, to electrodeless lamps having a fill including a rare earth constituent. Accordingly, it is a general object of this invention to provide new and improved lamps of such character.

2. Description of the Prior Art

High pressure electric discharge lamps of the electroded type containing mercury and metal iodides such as scandium iodide and sodium iodide provide high efficacy (about 100 lpW), but only fair color rendering (CRI≈65). In response to the need for high color rendering, tin halide lamps have been developed, in which the molecular continuum from the tin halide provides excellent color rendering, but only fair efficacy (about 60 lpW). However, the tin chloride used in such lamps tended to attack the tungsten electrodes, presenting a lifetime problem. In response to a need for a high efficacy and a high color rendering index for applications such as studio lighting, rare-earth halide fill lamps have been developed. The emission spectra of the rare-earth atoms provide many lines throughout the visible range. However, in order to get the rare-earth halide fills into the discharge, very high wall loadings are required, resulting in a rapid decrease in color temperature (about 1° K/hour) and a very short effective lifetime of about 200 hours.

A rare-earth halide electroded studio lamp having a fill consisting of mercury, dysprosium iodide, holmium iodide, cesium iodide, mercuric bromide, and argon ($Hg/DyI_3/CsI/HgBr_2/Ar$) is commercially available. Thus, the use of a rare-earth halide in electroded studio lamps is known.

One example of an electroded lamp filled with mercury and argon, and iodides of dysprosium, holmium and thulium, developed by OSRAM GmbH, Germany is discussed in an article entitled "A New Daylight Light Source" by Werner Block, Michael J. McGovern, and Thomas M. Lemons, September 1974, Journal of the SMPTE, Volume 83, pages 725–6.

Electrodeless lamps, per se, are known. For example, the following United States Patents, which may be of interest, relate to electrodeless lamps, usually at least one of the patentees of each patent is an applicant of this application, and all patents have been assigned to a common assignee.

| U.S. Pat. No. | Patentee | Issue Date |
|---|---|---|
| 3,942,058 | Haugsjaa et al. | March 2, 1976 |
| 3,942,068 | Haugsjaa et al. | March 2, 1976 |
| 3,943,401 | Haugsjaa et al. | March 9, 1976 |
| 3,943,402 | Haugsjaa et al. | March 9, 1976 |
| 3,943,403 | Haugsjaa et al. | March 9, 1976 |
| 3,943,404 | McNeill et al. | March 9, 1976 |
| 3,993,927 | Haugsjaa et al. | November 23, 1976 |
| 3,995,195 | Haugsjaa et al. | November 30, 1976 |
| 3,997,816 | Haugsjaa et al. | December 14, 1976 |
| 4,001,631 | McNeill et al. | January 4, 1977 |
| 4,001,632 | Haugsjaa et al. | January 4, 1977 |
| 4,002,943 | Regan et al. | January 11, 1977 |
| 4,002,944 | McNeill et al. | January 11, 1977 |
| 4,041,352 | McNeill et al. | August 9, 1977 |
| 4,053,814 | Regan et al. | October 11, 1977 |
| 4,065,701 | Haugsjaa et al. | December 27, 1977 |

-continued

| U.S. Pat. No. | Patentee | Issue Date |
|---|---|---|
| 4,070,603 | Regan et al. | January 24, 1978 |

Also of interest is the following U.S. patent which relates to electrodeless lamps. U.S. Pat. No. 3,787,705, Bolin et al. Jan. 22, 1974.

Prior Art Statement

The subject matter set forth in the Description of the Prior Art, set forth hereinabove, constitutes prior art which includes, in the opinion of the applicants and their attorney, the closest prior art of which they are aware. This prior art statement shall not be construed as a representation that a search has been made or that no better art exists.

SUMMARY OF THE INVENTION

Another object of this invention is to provide for new and improved electrodeless lamps which utilize rare-earth fill for desirable light characteristics.

Yet another object of this invention is to provide for new and improved lamps which provide unexpected, desirable light characteristics.

It is noted that the emission spectra of electrodeless lamps and electroded lamps are normally quite similar (at least in most cases) when a non-rare-earth fill in the two types of lamps are the same. However, electrodeless lamps and electroded lamps yield different spectra when the fill includes a rare-earth material.

In accordance with a preferred embodiment of this invention, electrodeless lamp apparatus includes an electrodeless light-transmitting envelope which houses a fill including a rare-earth compound. A termination fixture, electrodelessly coupled to the envelope, is adapted to create an electrical condition for exciting the fill. In accordance with certain features of the invention, the fill can further include mercury and a noble gas, such as argon. The rare-earth compound can be a rare-earth halide, such as dysprosium iodide, and holmium iodide. The fill can include a halide of mercury, such as mercuric bromide. The fill can include $Hy/DyI_3/HoI_3/CsI/HgBr_2/Ar$, which, for example, with 10 Torr of argon, can have a relation with respect to each other of 1.0 microliters, 2.45 milligrams, 2.30 milligrams, 3.50 milligrams, and 2.30 milligrams, respectively. Alternatively, the fill can include $Hg/NdI_3/DyI_3/CsI/Ar$, which, for example, with 10 Torr of argon, can have a relation with respect to each other of 1.2 microliters, 2.0 milligrams, 2.35 milligrams, and 2.20 milligrams. In another alternative, the fill can include $Hg/Pr/DyI_3/HgI_2/CsI/HgBr_2/Ar$, which, for example, with 10 Torr of argon, can have a relation with respect to each other of 1.1 microliters, 0.8 milligram, 2.15 milligrams, 2.90 milligrams, 2.60 milligrams, and 3.65 milligrams, respectively. In still yet another alternative, the fill can include $Hy/Yb/CsCl/HgCl_2/Ar$, which, for example, with 10 Torr of argon, can have a relation with respect to each other of 1.2 microliters, 2.90 milligrams, 1.55 milligrams, and 4.45 milligrams, respectively.

BRIEF DESCRIPTION OF THE DRAWING

Other objects, advantages and features of this invention, together with its construction and mode of operation, will become more apparent from the following description, when read in conjunction with the accompanying drawing, in which:

FIG. 1 is a front sectional view of an electrodeless light source in accordance with a preferred embodiment of this invention;

FIG. 2 is a spectral power distribution of a rare-earth halide electroded studio lamp having a fill consisting of $Hg/DyI_3/CsI/HgBr_2/Ar$; and FIG. 3 is a spectral power distribution of a rare-earth halide electrodeless lamp having a fill consisting of $Hg/DyI_3/CsI/HgBr_2/Ar$ in accordance with a preferred embodiment of this invention.

DESCRIPTION OF EMBODIMENTS OF THE INVENTION

Electrodeless lamps have the potential for extremely long life because there is no need for the arc discharge to be in contact with any material, either electrodes (i.e., since there are none) or the lamp envelope.

In an exemplary embodiment of this invention, as shown in FIG. 1, a light source includes a source of power (not shown) at a high frequency, an electrodeless lamp 10, and a termination fixture 12 coupled to the source, such as by a coaxial cable including an inner conductor 14 and an outer conductor 16. As used herein, the phrase "high frequency" is intended to include frequencies in the range generally from 100 MHz to 300 GHz. Preferably, the frequency is in the ISM band (i.e., industrial, scientific and medical band) which ranges from 902 MHz to 928 MHz. A particularly preferred frequency is 915 MHz. One of the many commercially available power sources which may be used is an AIL Tech Power Signal Source, type 125. The lamp has an envelope 10 made of a light transmitting substance, such as quartz. The envelope encloses a volatile fill material which produces a light emitting discharge upon excitation. Several known fill materials may be used which produce a high pressure discharge.

This invention relates to the enhanced rare-earth halide continua observed in an electrodeless light source with a termination fixture, relative to light sources operated at low frequency with electrodes. By virtue of the synergistic effect between the rare-earth halide fill in the lamp and the electrodeless lamp excited in a termination fixture, the spectral distribution of the radiation is strongly altered. This unexpected, enhanced molecular radiation now provides the opportunity to make electrodeless discharge lamps with many unique characteristics.

In FIG. 1, a termination fixture 12 includes an inner conductor 14 and an outer conductor 16. As shown herein, the outer conductor 16 is disposed around the inner conductor 14. The conductors have active portions in the immediate vicinity of the electrodeless lamp 10 which are adapted to couple power to the lamp to produce excitation, and opposite ends adapted to be coupled to the source. The fixture 12 includes, as an arc shaping means, a coil 18 which is directly affixed to the inner conductor 14. The coil 18 produces an electric field in the region of the lamp in an axial direction with respect to the inner conductor 14, or with respect to the axis of the coil 18.

As an example, FIG. 1 depicts a "football" shaped or prolate spheroid lamp with a rare-earth fill as described in greater detail below. The coil 18 can be formed of a 0.060 inch nickel tubing. The lamp diameter at its largest point can be 18.3 millimeters with a 1 millimeter wall thickness (the lamp being formed of quartz), and a length from tip-to-tip of 40 millimeters.

Alternatively, the lamp can be formed in a cylindrical configuration. The coil 18 can be formed of tungsten wire. The diameter of the electrodeless lamp 10 can be 10 millimeters, with a length of 30 millimeters and a wall thickness of 3 mm.

In essence, the electrodeless lamp apparatus includes an electrodeless lamp 10 including an electrodeless, light-transmitting, envelope for housing a fill incorporating a rare-earth compound. A termination fixture, including the inner conductor 14 and outer conductor 16, is adapted to create an electrical condition for exciting the fill by being electrodelessly coupled to the envelope. The fill can include mercury and a noble gas such as argon. Preferably, the rare-earth compound is a rare-earth halide, such as dysprosium iodide, or holmium iodide. The fill can include a halide of mercury, such as mercuric bromide.

In one embodiment, the fill with 10 Torr of argon, can include chemicals having the following relationship:

| | |
|---|---|
| Hg | 1.0 microliters |
| $DyI_3$ | 2.45 milligrams |
| $HoI_3$ | 2.30 milligrams |
| $HgBr_2$ | 3.50 milligrams |
| CsI | 2.30 milligrams |

In a second embodiment, the fill, with 10 Torr of argon, can include chemicals having the following relationship:

| | |
|---|---|
| Hg | 1.2 microliters |
| $NdI_3$ | 2.0 milligrams |
| $DyI_3$ | 2.35 milligrams |
| CsI | 2.20 milligrams |

In a third embodiment, the fill, with 10 Torr of argon, can include chemicals having the following relationship:

| | |
|---|---|
| Hg | 1.1 microliters |
| Pr | 0.8 milligram |
| $DyI_3$ | 2.15 milligrams |
| $HgI_2$ | 2.90 milligrams |
| CsI | 2.60 milligrams |
| $HgBr_2$ | 3.65 milligrams |

In a fourth embodiment, the fill, with 10 Torr of argon, can include chemicals having the following relationship:

| | |
|---|---|
| Hg | 1.2 microliters |
| Yb | 2.90 milligrams |
| CsCl | 1.55 milligrams |
| $HgCl_2$ | 4.45 milligrams |

As stated earlier, rare-earth halide electroded lamps are known. The spectral power distribution of such an electroded lamp having a fill which consists $Hg/DyI_3/HoI_3/CsI/HgBr_2/Ar$ with 20 Å resolution is shown at FIG. 2, which, because of the poor resolution, the individual rare-earth atomic lines are not apparent.

At the bottom of FIG. 3, the spectral power distribution from an electrodeless lamp in a termination fixture, containing virtually the same quantitative fill, is shown.

The electrodeless lamp contains a large amount of radiation centered at about 6000 Å relative to the electroded lamp. Higher resolution spectra show that this emission at about 6000 Å is either from true rare-earth halide continua or many over-lapping rare-earth halide bands which look like continua. (For simplicity of description, the term continua is used to describe both of these possibilities.) Although a small amount of molecular continua is present in the electroded rare-earth lamp, the greatly enhanced rare-earth halide continua in the electrodeless lamp so alters the characteristics of the lamp that the color temperature of the electrodeless lamp drops to 3439° K. from 5961° K. for the electroded lamp. In addition, the enhanced rare-earth halide continua at about 6000 Å increases the efficacy of the electrodeless lamp relative to the electroded lamp because the peak photoptic response is at about 5550 Å.

In both the electrodeless and electroded lamps, the radial temperature profile can be approximated by a parabolic or Gaussian function, and ranges from a wall temperature of about 1000° K. to an axis temperature of about 5000° K. and then back again to the wall temperature. At the wall, the rare-earth halide exists as the tri-halide and progressively loses halide with increasing temperature until, at the core of the arc, the free rare-earth atoms predominate. In the mantle of the arc at about 3000° K. to 4000° K., rare-earth monohalides and perhaps dihalides can exist and emit molecular radiation because of their populated excited states. Thus, the molecular radiation comes from the cooler mantle regions of the lamp. A major fraction of the molecular rare-earth halide radiations in an electrodeless lamp comes from the ends of the lamp. At the ends of the lamp, the axis temperature must decrease to the wall temperature. This cooler transition region is very effective for producing molecular radiation. In addition, the arc shaping capabilities of the termination fixture ensure low electric field strengths at the ends of the lamp and significantly increase the volume of this transition region. In an electroded lamp, the end effects do not exist because the arc terminates on the electrodes. In support of such thesis involving end effects, an electrodeless rare-earth halide lamp with the top and bottom thirds of the lamp masked had a color temperature of 4520° K., while the whole lamp had a color temperature of 3445° K.

The use of rare-earth halide fills in electrodeless lamps combines the high efficacy and good color rendering of the rare-earth atomic lines with the inherent good color rendering of a continuum. Because of the high predominance of rare-earth lines in the blue, electroded rare-earth lamps tend to have a high color temperature. The addition of the molecular continuum allows for low (warm) color temperatures. All the rare-earth halides exhibit molecular continua in an electrodeless lamp. Some individual rare-earth halides have continua radiation which covers the entire visible region, while other individual rare-earth halides have continuum radiation which is principally in one region of the spectrum. By combining more than one rare-earth halide in a lamp, the radiation in different spectral regions can be enhanced. By using different halides, for example, Cl or Br or combinations, the continuum radiation can be shifted to different parts of the spectrum. (The ability to shift the radiation can significantly affect the color balance in the lamp.) The use of chlorides in an electrodeless lamp presents no problems because of the absence of tungsten electrodes. Fluorides are possible for use if the stability of the rare-earth fluorides and mercuric fluoride is higher at the lamp walls than atomic or molecular fluorine. The absence of electrodes suggests that the electrodeless rare-earth halide lamps of this invention should have significantly longer life, significantly smaller changes in color temperature, and good lumen maintenance.

The present invention enables one to make compact, high brightness electrodeless lamps as visible light sources with excellent color rendering, high efficacy and variable color temperature. Lamps which predominantly emit radiation in one part of the visible spectrum for specialized applications can be constructed. The enhancement of molecular radiation can be extended to other metal halide fills. in a lamp containing $Hg/ScCl_3/CsCl/Ar$, molecular bands from ScCl were observed.

In essence, this invention relates to a light source which effectively utilizes two separately known components: an electrodeless lamp, and a rare-earth fill. Each was separately known. However, by using a rare-earth fill in an electrodeless lamp, an unexpected synergistic result is obtained. Normally, with the same non-rare earth fill, the same sort of discharge is obtained with an electrodeless lamp as with an electroded lamp. However, as set forth above, the results with a rare-earth fill between an electroded lamp and an electrodeless lamp are dramatic.

An electroded discharge does not extend beyond the tips of the electrodes. However, the whole volume behind an electrodeless discharge, effectively, can be utilized to emit light.

The use of different types of rare-earth and different types of halides is believed new. As a preferred embodiment, the use of cesium iodide or cesium halide to modify the temperature distribution and enhance the volatility of the rare-earth yields a desirable operation.

Effectively, the mercury and argon are desirable to initiate the discharge and to get the lamp up to operating pressure. The rare-earth is added to yield a desirable emission, or desirable color.

In substance, the invention utilizes various features: first, a fill with an electrodeless lamp wherein excitation of the fill yields a continuum emission; two, a high pressure discharge is obtained; three, the discharge is excited by microwaves; and four, the lamp can be excited in a particular way such as field shaping (such as described in U.S. Pat. Nos. 3,942,058; 3,942,068; and 3,943,404).

As stated in an earlier discussion, mercury is needed for a high pressure discharge, argon is used to initiate the discharge, and a rare-earth halide is used to achieve atomic plus molecular emission. The results are improved with the addition of cesium halide, but, basically, only mercury, argon, and a rare-earth halide is necessary. Mercury halide is not necessary. Mercury bromide when combined with holmium iodide, and excited electrodelessly, yields a molecular emission from both holmium bromide as well as holmium iodide. Similarly, mercury bromide when mixed with dysprosium iodide, and electrodelessly excited, yields molecular emission from dysprosium iodide and dysprosium bromide. Thus, a broader continuum is achieved. To tailor the spectrum to any desired degree, various combinations of rare-earth halides can be used.

Rare-earth chlorides are preferred to rare-earth fluorides because of volatility. Also, it is believed (though not certain) that one or more of the rare-earth flourides attack quartz (which is normally used as the lamp envelope). Another problem is that the wall temperature has to be raised to a temperature hotter than the melting temperature of quartz in order to achieve a vapor pressure high enough for the flourides due to their low volatility. However, different envelope materials could be used, such as alumina.

Though an electroded lamp with a rare-earth fill yields a fairly broad spectrum, as shown in FIG. 2, the electrodeless lamps with a rare-earth fill tend to peak at about 6000 Å, yielding light approximating that of an incandescent lamp, which is advantageous for various purposes where such color rendering is desirable, such as TV studio lighting.

Other variation will suggest themselves to those skilled in the art without departing from the scope of the invention as defined by the appended claims.

We claim:

1. Electrodeless lamp apparatus comprising
(a) a fill including a rare-earth compound;
(b) an electrodeless, light-transmitting, envelope for housing said fill; and
(c) excitation means, electrodelessly coupled to said envelope, adapted to create an electrical condition for exciting said fill.

2. The apparatus as recited in claim 1 wherein said excitation means is a termination fixture.

3. The apparatus as recited in claim 2 wherein said termination fixture includes field shaping couplers which excite a broad arc which avoids termination on said envelope.

4. The apparatus as recited in claim 1 wherein said fill further includes mercury and a noble gas.

5. The apparatus as recited in claim 4 wherein said noble gas is argon.

6. The apparatus as recited in claim 1 wherein said rare-earth compound is a rare-earth halide.

7. The apparatus as recited in claim 6 wherein said rare-earth compound is dysprosium iodide.

8. The apparatus as recited in claim 6 wherein said rare-earth compound is holmium iodide.

9. The apparatus as recited in claim 5 wherein said fill includes a halide of mercury.

10. The apparatus as recited in claim 9 wherein said fill includes $HgBr_2$.

11. The apparatus as recited in claim 1 wherein said fill includes $Hg/DyI_3/HoI_3/CsI/HgBr_2/Ar$.

12. The apparatus as recited in claim 11 wherein said fill, with 10 Torr of argon, includes chemicals related as follows:

| | |
|---|---|
| Hg | 1.0 microliters |
| $DyI_3$ | 2.45 milligrams |
| $HoI_3$ | 2.30 milligrams |
| $HgBr_2$ | 3.50 milligrams |
| CsI | 2.30 milligrams |

13. The apparatus as recited in claim 1 wherein said fill includes $Hg/NdI_3/DyI_3/CsI/Ar$.

14. The apparatus as recited in claim 13 wherein said fill, with a 10 Torr of argon, includes chemicals related as follows:

| | |
|---|---|
| Hg | 1.2 microliters |
| $NdI_3$ | 2.0 milligrams |
| $DyI_3$ | 2.35 milligrams |
| CsI | 2.20 milligrams |

15. The apparatus as recited in claim 1 wherein said fill includes $Hg/Pr/DyI_3/HgI_2/CsI/HgBr_2/Ar$.

16. The apparatus as recited in claim 15 wherein said fill, with 10 Torr of argon, includes chemicals related as follows:

| | |
|---|---|
| Hg | 1.1 microliters |
| Pr | 0.8 milligram |
| $DyI_3$ | 2.15 milligrams |
| $HgI_2$ | 2.90 milligrams |
| CsI | 2.60 milligrams |
| $HgBr_2$ | 3.65 milligrams |

17. The apparatus as recited in claim 1 wherein said fill includes $Hg/Yb/CsCl/HgCl_2/Ar$.

18. The apparatus as recited in claim 17 wherein said fill, with 10 Torr of argon, includes chemicals related as follows:

| | |
|---|---|
| Hg | 1.2 microliters |
| Yb | 2.90 milligrams |
| CsCl | 1.55 milligrams |
| $HgCl_2$ | 4.45 milligrams |

* * * * *